US011607018B2

(12) United States Patent
Kim

(10) Patent No.: US 11,607,018 B2
(45) Date of Patent: Mar. 21, 2023

(54) RING WITH ROTATION AND LOCK FUNCTION TO SELECTIVELY DISPLAY MULTIPLE JEWELS

(71) Applicant: Young Gil Kim, Seoul (KR)

(72) Inventor: Young Gil Kim, Seoul (KR)

( * ) Notice: Subject to any disclaimer, the term of this patent is extended or adjusted under 35 U.S.C. 154(b) by 101 days.

(21) Appl. No.: 17/323,894

(22) Filed: May 18, 2021

(65) Prior Publication Data

US 2022/0007800 A1 Jan. 13, 2022

(30) Foreign Application Priority Data

Jul. 7, 2020 (KR) ..... 10-2020-0083414

(51) Int. Cl.
*A44C 9/00* (2006.01)
*A44C 9/02* (2006.01)

(52) U.S. Cl.
CPC ..... *A44C 9/02* (2013.01); *A44C 9/003* (2013.01)

(58) Field of Classification Search
CPC ..... A44C 9/0053; A44C 9/02; A44C 9/003; A44C 9/0061; A44C 9/00; A44C 5/003; A44C 5/0092; A44C 15/0025; A44C 17/025; A44C 17/0241; A44C 17/02
USPC ..... 63/15, 3, 26, 28, 31, 40
See application file for complete search history.

(56) References Cited

U.S. PATENT DOCUMENTS

| | | | | | |
|---|---|---|---|---|---|
| 1,146,543 | A * | 7/1915 | Abel | A44C 9/00 | 63/15 |
| 1,333,284 | A * | 3/1920 | Schreiber | A44C 9/0053 | 224/217 |
| 4,416,074 | A * | 11/1983 | Guerrero | G02B 27/06 | 63/23 |
| 2019/0246752 | A1 * | 8/2019 | Krainz | A44C 9/02 | |

FOREIGN PATENT DOCUMENTS

| | | | | |
|---|---|---|---|---|
| DE | 102004038907 | A1 * | 2/2006 | A44C 15/0035 |
| EP | 1797786 | A1 * | 6/2007 | A44C 27/00 |
| JP | 3058861 | U | 6/1999 | |
| JP | 3151289 | B2 | 1/2001 | |
| KR | 20-0460469 | Y1 | 5/2012 | |
| WO | WO-9621374 | A1 * | 7/1996 | A44C 17/02 |

* cited by examiner

*Primary Examiner* — Jack W Lavinder
(74) *Attorney, Agent, or Firm* — Korus Patent, LLC; Seong Il Jeong

(57) ABSTRACT

A ring with a rotation and a lock function to selectively display multiple jewels is configured to comprise a first side including a first hole; a second side positioned in an opposite side to the first side and including a second hole that is smaller than the first hole; a third side bended from the first side; a fourth side bended from the first side and positioned in an opposite side to the third side; a space formed between the first and the second side; a plurality of receivers positioned in the space and meeting with the second side; elastic members respectively positioned in the plurality of receiver, and jewels respectively sitting on the elastic members, wherein the second side and the plurality of the receivers are rotatable in a state that the first, the third, and the fourth side are fixed.

4 Claims, 6 Drawing Sheets

RING WITH ROTATION AND LOCK FUNCTION TO SELECTIVELY DISPLAY MULTIPLE JEWELS

TECHNICAL FIELD

The invention relates to a ring with a rotation and a lock function to selectively display multiple jewels and more particularly, a ring that can selectively display various jewels according to a user preference.

BACKGROUND ART

Generally, a ring is an accessory that people can express their individualities according to surroundings, atmospheres, and psychological situations. The ring is used by putting it on the finger of a user.

Recently, people with various personalities tend to choose accessories as means to express their own unique individualities. According to requests of the public, it is required that the design of rings be changed according to fads or the tastes of young generation, who want unique appearances different from others.

There are problems that the conventional rings whose designs, jewels, decorations, or patterns fixed to the ring body are difficult to respond to rapid changes in fads or public demands as well as have limitations to satisfy the demands of the young generation.

Especially, since the beauty and uniqueness of the ring mostly come from the jewels exposed to outside, people purchase multiple rings to express various kinds of beauty, thereby causing excessive spending on the accessories.

DISCLOSURE

Technical Problem

Accordingly, one object of the present invention is to provide a ring with a rotation and a lock function to selectively display multiple jewels according to a user preference.

The object of the present invention is not limited to the objects mentioned above. It would be apparent that other objects of the invention, which are not mentioned above, can be understood by one skilled in this technical field.

Technical Solution

A ring with a rotation and a lock function to selectively display multiple jewels according to one embodiment of the invention to solve the problems is configured to comprise: a first side including a first hole; a second side positioned in an opposite side to the first side and including a second hole that is smaller than the first hole; a third side bended from the first side; a fourth side bended from the first side and positioned in an opposite side to the third side; a space formed between the first and the second side; a plurality of receivers positioned in the space and meeting with the second side; elastic members respectively positioned in the plurality of receiver, and jewels respectively sitting on the elastic members, wherein the second side and the plurality of the receivers are rotatable in a state that the first, the third, and the fourth side are fixed.

The first hole has a first width and a second width that is narrower than the first width in a first direction.

The plurality of the receivers is arranged to be spaced apart to each other along the second side, wherein the jewels are movable in a second direction intersecting the first direction and an opposite direction to the second direction.

A part of the jewels positioned in the receiver that is aligned with the first hole among the plurality of the receivers is protruded outward from the first hole, the other part of the jewels positioned in the receiver that is not aligned with the first hole among the plurality of the receivers is positioned inside the second hole.

Each of the plurality of the receivers includes a groove, and a third width of the groove in the first direction is broader than the first width.

The elastic member and the jewel sit on the groove, and the groove has a circular cylindrical shape.

Detailed elements and/or component of other embodiments are included in the description and drawing.

Advantageous Effects

According to one embodiment of a ring with a rotation and a lock function to selectively display multiple jewels, the ring comprises multiple jewels engaged with elastic members and can display the jewel to the outside according to the rotations. Consequently, a user can adjust the jewel displayed to the outside according to his or her preference.

The technical effects of the embodiments are not limited to the mentioned above. More various effects may be included in the description.

MODE FOR INVENTION

Hereinafter, the advantages, characteristics, and means to achieve those of the present invention will be described in detail with embodiments in conjunction with the accompanying drawings. However, the present invention is not limited to the embodiments disclosed below and can be embodied as various types. The embodiments are provided to be illustrative of the present invention to one skilled in the art. The present invention is defined by the scope of the appended claims.

When an element or a layer is disposed "on" other elements or layers, it includes the structures that the element or layer is disposed right above the other element and there is a third element disposed between the element and the other element. The same referral number indicate the same element over the description.

Although expressions such as "first" and "second" are used to describe various elements, these elements are not limited by these expressions. The above elements are used merely for the purpose of distinguishing an element from the other elements. Accordingly, a first element may be referred to as a second element, and likewise a second element may also be referred to as a first element, without departing from the scope of embodiments of the present disclosure.

Hereinafter, specific embodiments will be described in conjunction with the accompanying drawings.

Figure 1:
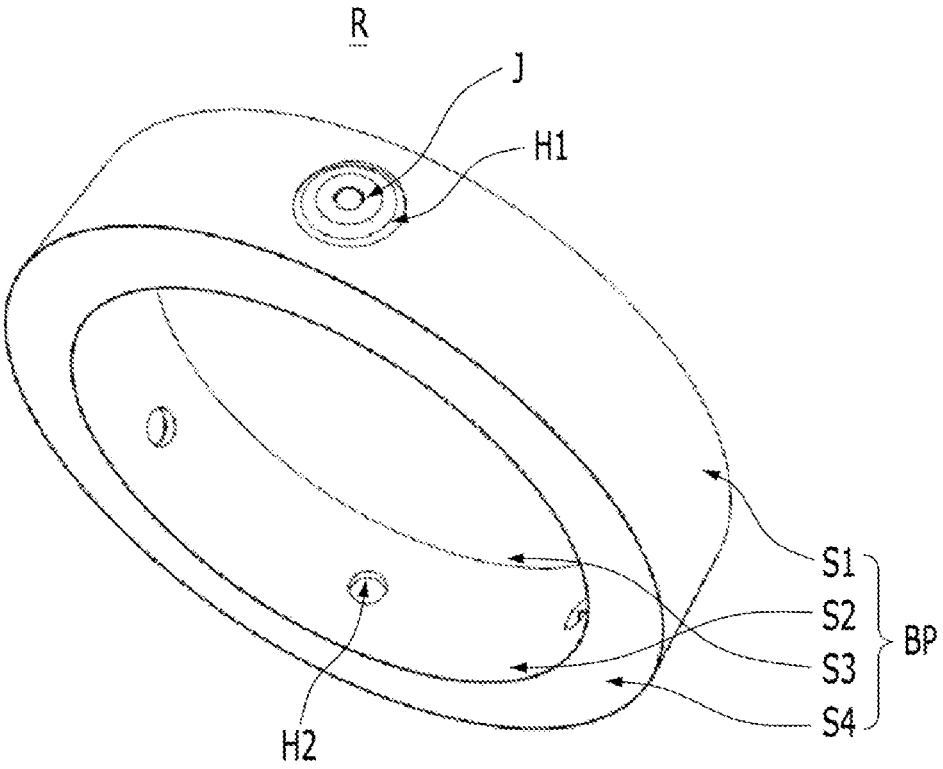
FIG. 1 is a perspective view showing a ring with a rotation and a lock function to selectively display multiple jewels according to one embodiment of the present invention.
Figure 2:
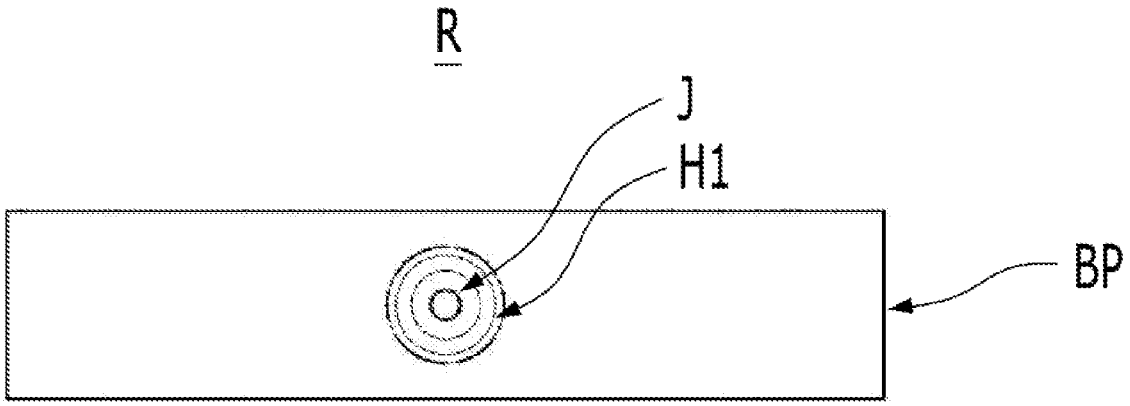
FIG. 2 is a top view schematically showing a ring with a rotation and a lock function to selectively display multiple jewels according to one embodiment of the present invention.
Figure 3:
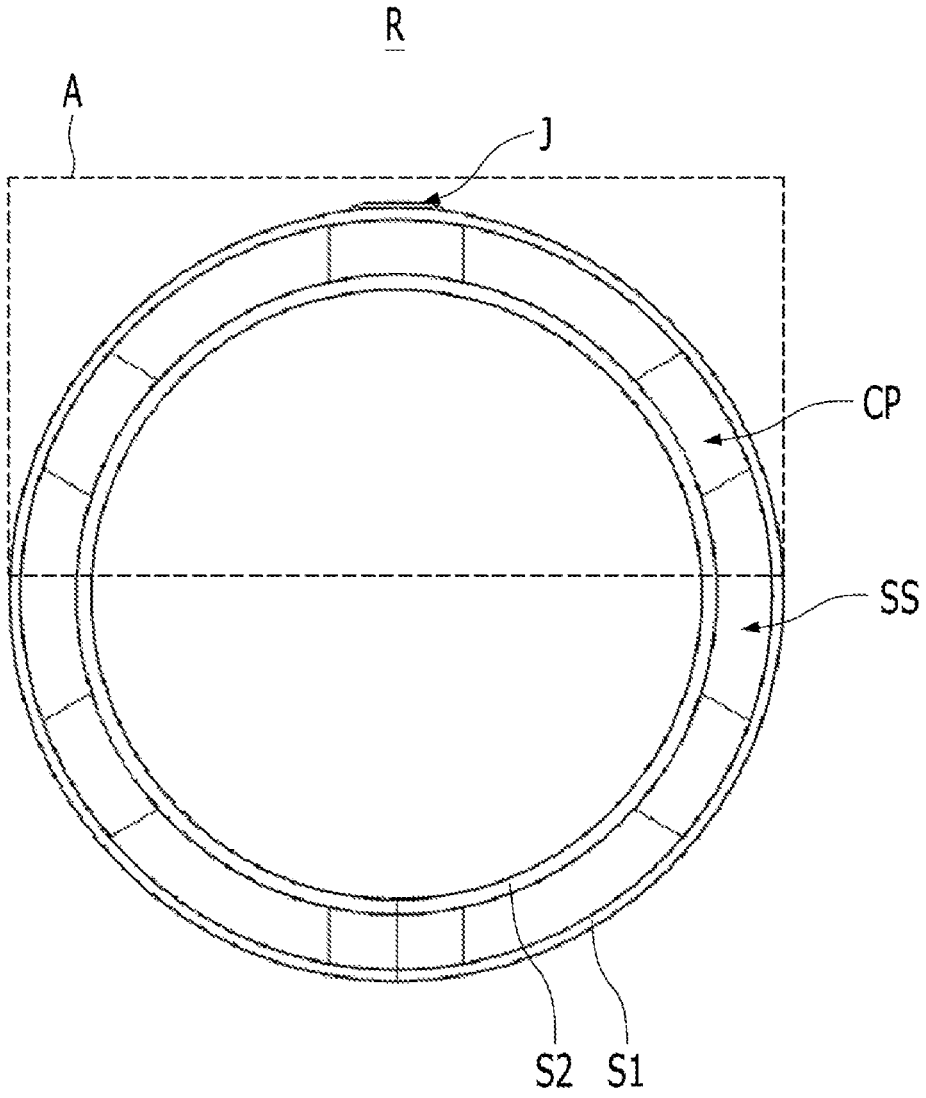
FIG. 3 is a drawing schematically showing a receiver of a ring with a rotation and a lock function to selectively display multiple jewels according to one embodiment of the present invention.
Figure 4:
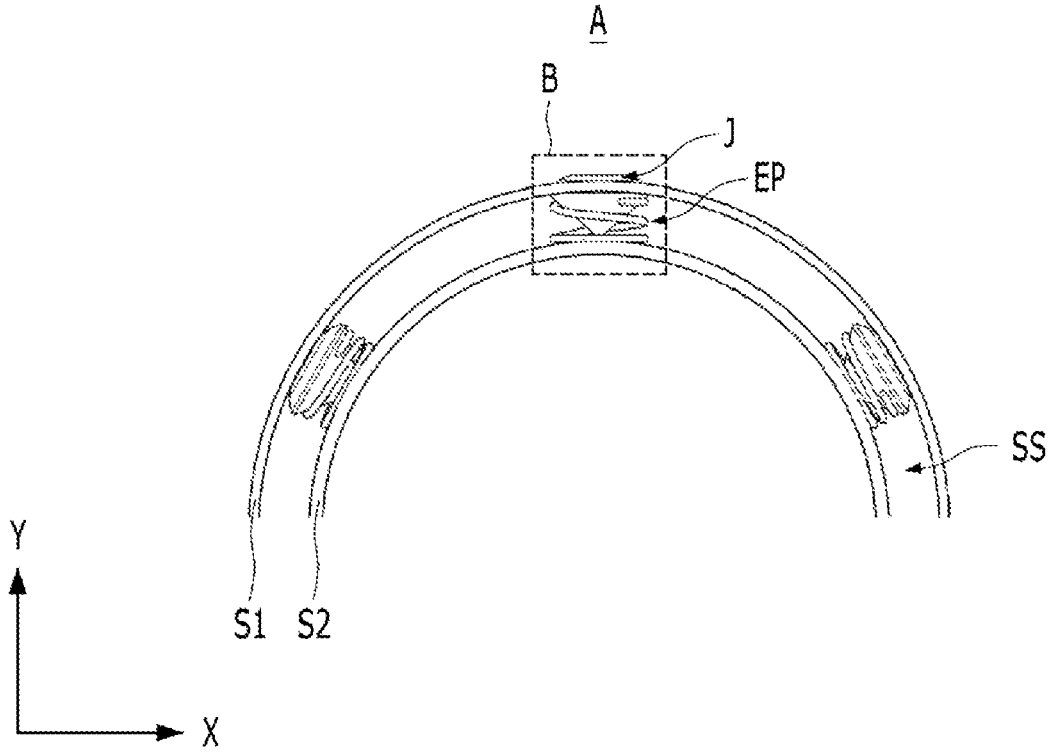
FIG. 4 is a reference drawing to explain an internal view of the receiver corresponding to an A portion of FIG. 3.
Figure 5:
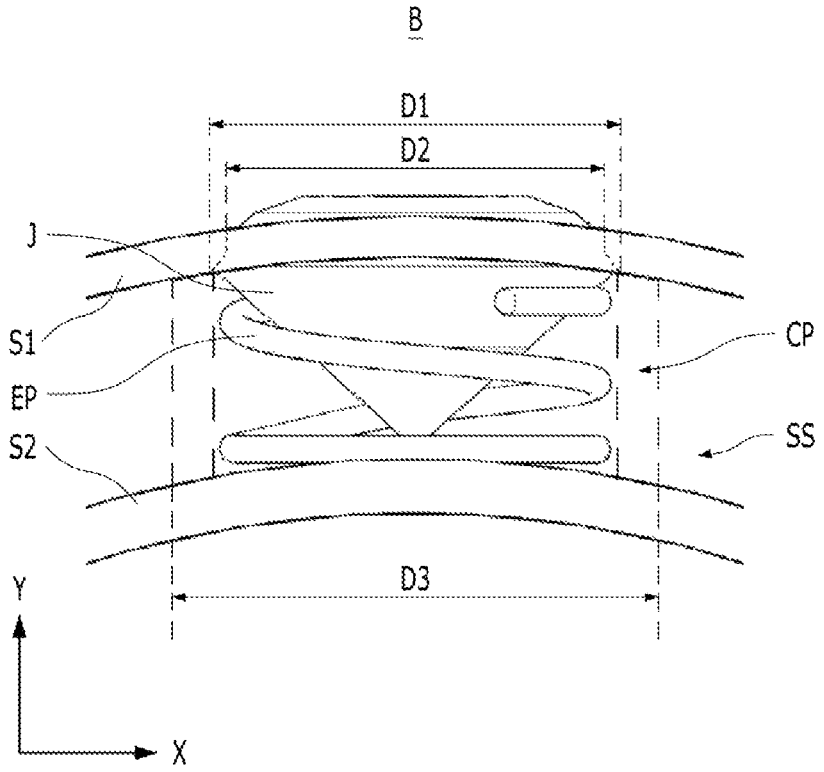
FIG. 5 is a drawing schematically showing a magnified view of a B portion of FIG. 4.
Figure 6:
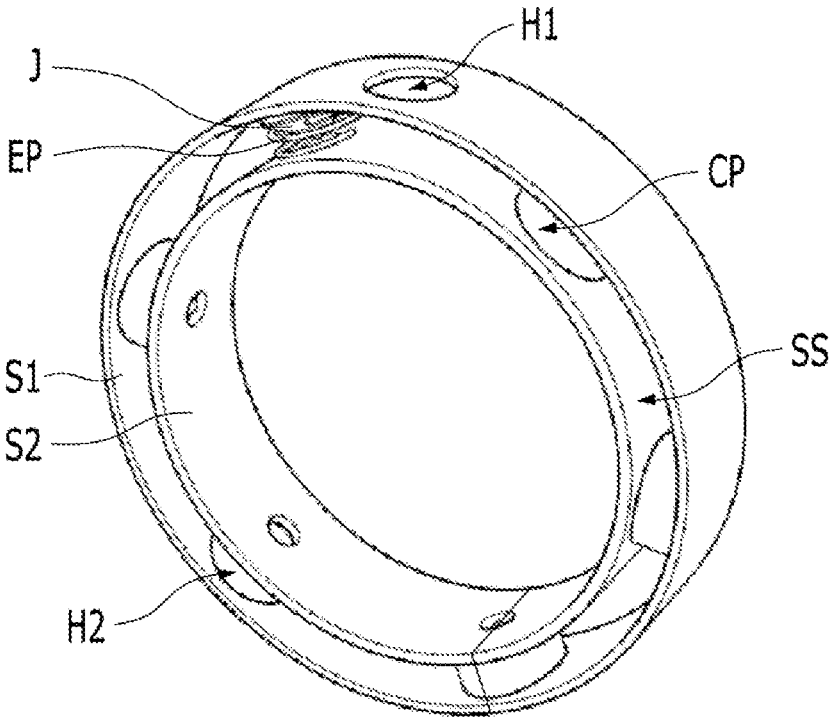
FIG. 6 is a perspective view schematically showing of is an internal view of a ring with a rotation and a lock function to selectively display multiple jewels according to one embodiment of the present invention.
Figure 7:
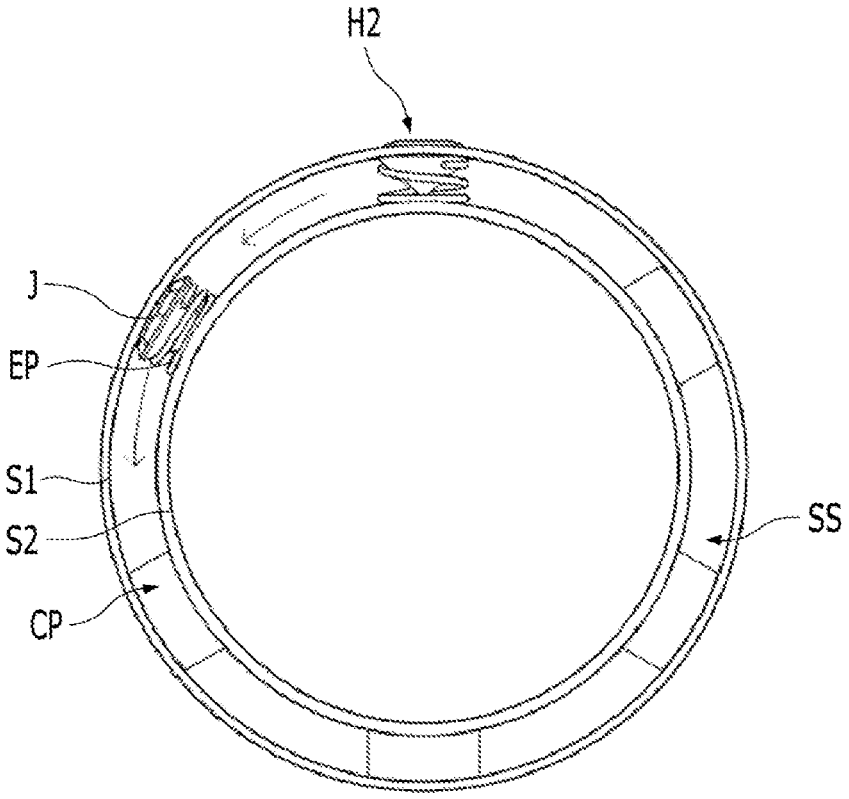
FIG. 7 is a reference drawing to explain a rotation of a ring with a rotation and a lock function to selectively display multiple jewels according to one embodiment of the present invention.

FIG. 1 is a perspective view showing a ring with a rotation and a lock function to selectively display multiple jewels according to one embodiment of the present invention. FIG. 2 is a top view schematically showing a ring with a rotation and a lock function to selectively display multiple jewels according to one embodiment of the present invention. FIG. 3 is a drawing schematically showing a receiver of a ring with a rotation and a lock function to selectively display multiple jewels according to one embodiment of the present invention. FIG. 4 is a reference drawing to explain an internal view of the receiver corresponding to an A portion of FIG. 3. FIG. 5 is a drawing schematically showing a magnified view of a B portion of FIG. 4. FIG. 6 is a perspective view schematically showing of is an internal view of a ring with a rotation and a lock function to selectively display multiple jewels according to one embodiment of the present invention. FIG. 7 is a reference drawing to explain a rotation of a ring with a rotation and a lock function to selectively display multiple jewels according to one embodiment of the present invention.

Referring to FIGS. 1 and 2, a ring R with a rotation and a lock function to selectively display multiple jewels according to one embodiment comprises: a first side S1 toward outside; a second side S2 positioned in an opposite side to the first side S1 and meeting with a finger of a user; a third side S3 and a fourth side that are bended from the first side S1 and opposite to each other. The second side S2 may be engaged with the third and the fourth side S3, S4. In addition, the second side S2 can rotate in a state of being engaged with the first, the third, and the fourth side S1, S3, S4. For example, the first, the third, and the fourth side S1, S3, S4 are formed as one body, and the second side S2 is engaged with them. Accordingly, the first, the third, and the fourth side S1, S3, S4 are rotatable with respect to the second side S2, and the second side S2 is rotatable with respect to the first, the third, and the fourth side S1, S3, S4.

In some embodiments, the first side S1 may include a first hole H1, and the second side S2 includes the second holes H2. The size of the first hole H1 may be bigger than that of the second hole H2. In addition, the number of the second holes H2 is more than that of the first hole H1.

In some embodiments, the number of the second holes H2 may correspond to that of jewels J contained inside the ring R.

A portion of the jewel J may be exposed through the first hole H1. For example, a top side of the jewel, which a user wants to choose, may be exposed to outside. The lower portion of the jewels contained inside the ring R may be located on the second holes H2, and the second hole H2 may serve as a channel through which the jewels can move to the second side S2. For example, the first hole H1 and any one of the plurality of the second holes H2 may face each other. In the location of the other of the second holes H2, which does not face the first hole H1, the jewel is moved downward by the first side S1 and located inside the second hole H2. The rotation of the jewel J will be described later in more detail.

In drawings, the first hole H1 is illustrated to be single, but the first hole H1 may be plural. In addition, the shapes of the first and the second holes H1, H2 are illustrated to be circle, but the first and the second holes H1, H2 may have various shapes such as a triangle shape, an oval shape, a quadrangle shape, and so on.

Referring to FIG. 3, a space SS may be formed between the first and the second side S1, S2, which are opposite to each other. In addition, the space SS may be surrounded by the first to the fourth side S1, S2, S3, S4. Thus, the ring R with a rotation and a lock function to selectively display multiple jewels according to one embodiment may be configured to include the space SS having a ring shape inside.

In some embodiments, the receiver CP may be positioned in the space SS. The receiver CP functions as a storage to store the jewel J and may have a groove. The groove may have a circular cylindrical shape but is not limited to.

The receiver CP may be plural, and the plurality of the receivers CP may be arranged or positioned in the space SS. In addition, the receiver CP may have a structure that is fixed to the second side S1 and is separated from the first side S1. As illustrated in FIG. 6, the receiver CP may be a circular cylindrical shape having a space which can store the jewels inside but is not limited to. The receiver CP may have various shapes such as an elliptic cylindrical shape having a space which can store the jewels inside, a quadrangular cylindrical shape having a space which can store the jewels inside, a triangular cylindrical shape having a space which can store the jewels inside, and so on. In some embodiments, the size of the receiver CP may be bigger than that of the first hole H1.

In addition, as illustrated in FIG. 6, the second holes H2 may be located on the second side S2 where the receivers CP are located. As described above, the receivers CP are fixed to the second side S2 and can rotate with the second side S2.

In some embodiments, the receiver CP may be plural, and the plurality of the receivers CP may be arranged to be spaced apart to each other along the second side S2. The jewels J may be positioned inside the receivers CP, respectively. Furthermore, the jewels J respectively positioned inside the plurality of the receivers CP may be different from each other. For example, the jewels J respectively positioned inside the plurality of the receivers CP may be different kinds of jewels, and the jewels J respectively positioned inside the plurality of the receivers CP may have different colors. The shapes of the jewels respectively positioned inside the plurality of the receivers CP may have a diamond shape as illustrated in FIGS. 4 and 5. For example, the jewel respectively positioned inside the plurality of the receivers CP may have a stacked shape in a cross-section that a triangle shape, a first trapezoid shape, and a second trapezoid shape, which is smaller than the first trapezoid shape, are stacked from the bottom to the top in order. However, the shape of the jewel is not limited to the shapes mentioned above, the jewels J respectively positioned inside the plurality of the receivers CP may have a stacked shape in a cross-section that a triangle shape and a trapezoid shape are stacked from the bottom to the top in order. The jewels J respectively positioned inside the plurality of the receivers CP may have various shapes having stepped portions.

Referring to FIGS. 4 and 5, jewels J are respectively arranged or positioned inside the plurality of receivers CP, and the jewels J may be engaged with elastic members EP.

For example, the elastic member EP may be a spring surrounding the lower portion of the jewel J but is not limited to. The elastic member EP may be embodied using various means having elasticity.

The elastic members EP are positioned inside the plurality of the receiver CP, respectively, and the jewels J are positioned on the elastic member EP, respectively. Accordingly, the jewels J can be moved toward a second direction (Y-axis direction) and an opposite direction to the second direction (Y-axis direction), by the elastic members EP in a state that the jewels J are fixed to the receivers CP.

In some embodiments, the first hole H1 may have a step portion. For example, the width of the first hole H1 in a first direction (X-axis direction) may be divided into a first width D1 of the inner portion facing the second side S1 and a second width D2 of the outer portion, which is opposite to the inner portion. The first width D1 may be broader than the second width D2. Since the second width is formed to be narrower than the first width D1, thereby forming a step portion, the step portion can prevent the entirety of the jewel J from escaping from the first hole H1 to outside. In addition, the shapes of the jewels J positioned in the receivers CP may be formed based on the step portion of the first hole H1. In this instance, a thickness of the jewel J, which is protruded outward from the first side S1, may be controlled by adjusting the shape of the step portion of the first hole H1 and the shape of the jewel J.

In some embodiments, a third width D3 of the receivers CP in the first direction (X-axis direction) may be broader than the first width D1 (D3>D1>D2).

Referring to FIGS. 6 and 7, since the jewels J positioned in the plurality of the receivers CP can be rotated along the second side S2, the locations of the jewels J positioned in the plurality of the receivers CP may be divided into a case that the jewel J faces the first hole H1 (The jewel J and the first hole H1 aligned in the second direction, Y-axis direction) and the other case that the jewel J does not face the first hole H1 (The jewel J and the first hole H1 not aligned in the second direction, Y-axis direction).

Considering the structure of the ring R, it may seem that either the first, the third, the fourth side S1, S3, S4, and the first hole H1 formed in the first side S1 are rotated, or the second side S2, the receivers CP positioned in the second side S2, and the jewels J positioned in the receivers CP are rotated. However, for convenient explanation, the invention will be explained based on the latter case, where the first, the third, the fourth side S1, S3, S4, and the first hole H1 formed in the first side S1 are fixed, and the second side S2 is rotated.

When any one of the jewels J positioned in the receiver CP faces the first hole H1 while the jewels J are rotated along the second side S2, the jewel J rises in the second direction (Y-axis direction) and is exposed to outside since a force by the elastic member EP is applied to the jewel J in the second direction (Y-axis direction). In this case, the entirety of the jewel J does not escape from the first hole H1 to outside due to the step portion of the first hole H1, and the jewel J can be fixed while a portion of the jewel J is exposed to outside. In addition, for increasing the rotational force, a lock function may be released. Furthermore, in some embodiments, the lock function may be released by performing pressing the exposed jewel J and rotating the ring R at the same time.

In addition, when the second side S2 is rotated in a state that the jewel J is exposed to outside through the first hole H1 by the elastic member EP, the jewel J exposed to outside through the first hole H1 becomes to fall in the opposite direction to the second direction (Y-axis direction), and the location of the jewel J is changed to a space which does not face the first hole H1. In this case, the jewel J may be pressurized in the opposite direction to the second direction (Y-axis direction) by the first side S1, and the elastic member EP may be contracted. In this instance, the second hole H2 is formed in order to prevent the lower portion of the jewel from being pressurized and damaged by the second side S2 when the jewel receives a force in the opposite direction to the second direction (Y-axis direction). Furthermore, the second hole H2 helps the lower portion of the jewel to be stably positioned in the second hole H2. A width of the second hole H2 may be narrower than the second width D2 of the first hole H1.

As described above, the ring R with the rotation and the lock function to selectively display multiple jewels comprises the multiple jewels J and can display the jewel J through the first side S1 to outside according to rotation. Accordingly, the jewel J displayed through the first side S1 to outside can be easily changed according to preferences of a user.

Although embodiments of the present invention are described above, it would be apparent that many more modifications and variations than mentioned above are possible by an ordinary person skilled in the art without changing the true spirit and scope of the inventive concept. Thus, embodiments described above are to be considered illustrative and not limiting the scope of the present invention.

What is claimed is:

1. A ring with a rotation and a lock function to selectively display multiple jewels, the ring comprising:

a first side including a first hole;

a second side positioned in an opposite side to the first side and including a second hole that is smaller than the first hole;

a third side bent from the first side;

a fourth side bent from the first side and positioned in an opposite side to the third side;

a space formed between the first and the second side;

a plurality of receivers positioned in the space and meeting with the second side;

elastic members respectively positioned in the plurality of receivers, and jewels respectively sitting on the elastic members, wherein the second side and the plurality of the receivers are rotatable in a state that the first, the third, and the fourth side are fixed.

2. The ring of claim 1, wherein the first hole has a first width at an inner surface of the first side in a circumferential direction and a second width at an outer surface of the first side that is narrower than the first width.

3. The ring of claim 2, wherein the plurality of the receivers are arranged to be spaced apart to each other along the second side, wherein the jewels are movable in a radial direction.

4. The ring of claim 3, wherein a jewel positioned in a receiver that is aligned with the first hole among the plurality of the receivers is protruded outward from the first hole, and a jewel positioned in a receiver that is not aligned with the first hole among the plurality of the receivers is positioned inside the second hole.

* * * * *